US006360918B1

(12) United States Patent
Butler

(10) Patent No.: US 6,360,918 B1
(45) Date of Patent: Mar. 26, 2002

(54) BOTTLE

(75) Inventor: David George Butler, Bolton (GB)

(73) Assignee: Bettix Limited, Manchester (GB)

( * ) Notice: Subject to any disclaimer, the term of this patent is extended or adjusted under 35 U.S.C. 154(b) by 0 days.

(21) Appl. No.: 09/792,262

(22) Filed: Feb. 23, 2001

(51) Int. Cl.[7] ..... B67D 5/60
(52) U.S. Cl. ..... 222/136; 222/373.1
(58) Field of Search ..... 222/382, 383.1, 222/136, 145.1, 159

(56) References Cited

U.S. PATENT DOCUMENTS 4,154,369 A * 5/1979 Morane ..... 222/382
5,890,624 A * 4/1999 Klima et al. ..... 222/383.1
6,041,969 A * 3/2000 Parise ..... 222/383.1
6,182,865 B1 * 2/2001 Bunschoten et al. ..... 222/136

* cited by examiner

*Primary Examiner*—Philippe Derakshani
(74) *Attorney, Agent, or Firm*—Woodard, Emhardt, Naughton Moriarty & McNett

(57) ABSTRACT

A dispensing container, e.g. a trigger-spray bottle, for a liquid, e.g. a cleaning liquid which is an aqueous solution of a concentrate. The container comprises a bottle having a main chamber for holding the liquid to be dispensed and a secondary chamber of lesser volume than the main chamber for containing the concentrate. Liquid is dispensed from the main chamber by, for example, a trigger-spray unit. When the liquid in the main chamber is depleted, concentrate may be expressed from the secondary via a ducting arrangement into the main chamber of dilution and subsequent dispense.

13 Claims, 3 Drawing Sheets

BOTTLE

The present invention relates to a bottle and to a dispensing container.

Numerous forms of dispensing containers are used in the domestic environment, e.g. in the kitchen and garden. One type of such container which is particularly popular is the so-called "trigger-spray container" which comprises a bottle (holding a liquid to be dispensed) and a trigger-spray mounted on the mouth of the bottle and having a dip tube extending into a lower region thereof. On actuating the trigger, the contents of the bottle are discharged as a spray through the nozzle of the trigger-spray unit.

It is generally the case that, once the bottle is empty, the whole dispensing container (which is usually of plastics material) is simply discarded and this is obviously disadvantageous from the environmental point of view. It is of course possible to provide for re-use of the dispensing container by filling the bottle with liquid to be dispensed. This may be done in one of two ways. In one way, the householder has another container of the liquid to be dispensed (by the trigger-spray unit) and simply fills the bottle with that liquid. In another way, the householder has a concentrated version of the liquid to be dispensed and introduces the concentrate into the bottle for dilution to the required strength. In either case there is a disadvantage that the replacement liquid (concentrate) needs to be held in a separate container and transferred to the bottle to be replenished. This can be messy and spills may result unless extreme care and time is taken. Additionally concentrated chemicals can harm flooring and general surfaces if spillage occurs.

GB-A-2 129 774 discloses a squeeze-bottle liquid-dispensing container comprising a liquid holding bottle connected to an integral receptacle (of larger capacity than the liquid holding bottle) by an integral duct along which liquid from the liquid holding bottle may be dispensed therefrom into the receptacle. In the illustrated embodiment, the receptacle forms the upper part and one side of the container, the liquid holding bottle forms the lower part of the other side of the container, the integral duct extends upwardly alongside the wall of the liquid holding bottle to open into the receptacle laterally through the wall thereof, and between the upper part of the receptacle and the liquid holding bottle below there is a neck having a throat closed by a plug insertable through the mouth of the dispensing receptacle.

The squeeze bottle of GB-A-2 129 774 is intended to hold two different liquids (one in the liquid holding bottle and the other in the receptacle) that are intended to be mixed before dispensed from the squeeze-bottle. Thus, liquid from the liquid holding bottle is expressed into that in the receptacle for mixing therewith prior to dispense of the mixture from the squeeze-bottle.

Examples of liquids to be mixed would be adhesive and a catalysts therefor.

According to a first aspect of the present invention there is provided a bottle comprising a main chamber, a secondary chamber of lesser volume than the main chamber, a first duct providing communication between the main chamber and the mouth of the bottle and a second duct providing for communication between the main chamber and a lower region of the secondary chamber, said secondary chamber having a filling aperture located below the mouth of the bottle characterised in that the secondary chamber is provided above at least a portion of the main chamber and in that said first duct is to one side of said secondary chamber.

The invention also provides, in a second aspect, a dispensing container comprising (i) a bottle comprising a main chamber, a secondary chamber of lesser volume than the main chamber, a first duct providing communication between the main chamber and the mouth of the bottle and a second duct providing for communication between the main chamber and a lower region of the secondary chamber, said secondary chamber having a filling aperture located below the mouth of the bottle;

(ii) a dilutable concentrate in said secondary chamber;

(iii) a plug provided in said filling aperture to effect closure thereof; and (iv) a closure element on the mouth of the bottle.

The invention further provides, in a third aspect, a dispensing container comprising (i) a bottle comprising a main chamber, a secondary chamber of lesser volume than the main chamber, a first duct providing communication between the main chamber and the mouth of the bottle and a second duct providing for communication between the main chamber and a lower region of the secondary chamber, said secondary chamber having a filling aperture located below the mouth of the bottle;

(ii) a dilutable concentrate in said secondary chamber;

(iii) a plug provided in said filling aperture to effect closure thereof;

(iv) a diluted form of said concentrate in the main chamber; and (v) a closure element on the mouth of the bottle.

The bottle of the dispensing container of the third aspect of the invention may be as defined for the first aspect.

The liquid to be dispensed (from a dispensing container in accordance with the second or third aspect of the invention) will be contained in the main chamber and will be a dilute form of the concentrate provided in the secondary chamber. The dilute form of the concentrate will generally be an aqueous solution thereof. Once the main chamber is empty, it is possible to transfer concentrate from the secondary chamber to the main chamber via the aforementioned second duct. Subsequently water maybe introduced into the main chamber to dilute the concentrate so that the main chamber is re-filled ready for further use of the dispensing container. In this respect, it is preferred that the end of the second duct remote from the lower region of the secondary chamber opens generally transversely into the neck of the bottle to ensure that dilution water does not enter the second duct as this would have the effect of diluting the concentrate in the secondary chamber.

The liquid in the main chamber may for example be for anti-bacterial use or for cleaning use, e.g. for window cleaning, floor cleaning, general surface cleaning or degreasing.

In producing the dispensing container in accordance with the second or third aspect of the invention, the dilutable concentrate is introduced into the secondary chamber via the mouth of the bottle and the filling aperture before the plug is inserted into the latter. Most preferably the plug is spherical. This allows the plug to be "self-locating" in that the sphere may simply be dropped through the mouth of the bottle and locate on a (preferably part spherical) seating surface around the edge of the filling aperture. The sphere may then be firmly seated in the aperture by applying pressure to the sphere, e.g. by means of a rod inserted through the mouth of the bottle. The use of a spherical plug, with its capability for self-location, provides a considerable advantage over the use of other shaped plugs, e.g. cylindrical, which must be correctly orientated relative to the filling aperture before the plug can be inserted therein.

Preferably the upper region of the main chamber is defined by a partition element having a first generally horizontal portion extending from a first side of the main chamber towards the opposite second side thereof and a second generally upwardly extending portion, said secondary chamber being located above said first horizontal portion of the partition and said first duct being defined between said second vertical portion of the portion and said second side wall of the main chamber.

Preferably the bottle is a one piece, moulded plastics article. Conveniently the bottle is formed of a flexible plastics material which allows concentrate to be expressed from the secondary chamber (along the second duct) simply by squeezing opposed sides of the secondary chamber towards each other. In this respect, the closure element on the mouth of the bottle allows for pressure transfer of the concentrate.

A particularly preferred embodiment of liquid dispensing container in accordance with the invention incorporates a trigger-spray unit which provides the closure for the mouth of the bottle.

The invention will be further described by way of example only with reference to the accompanying drawings, in which.

Figure 1:
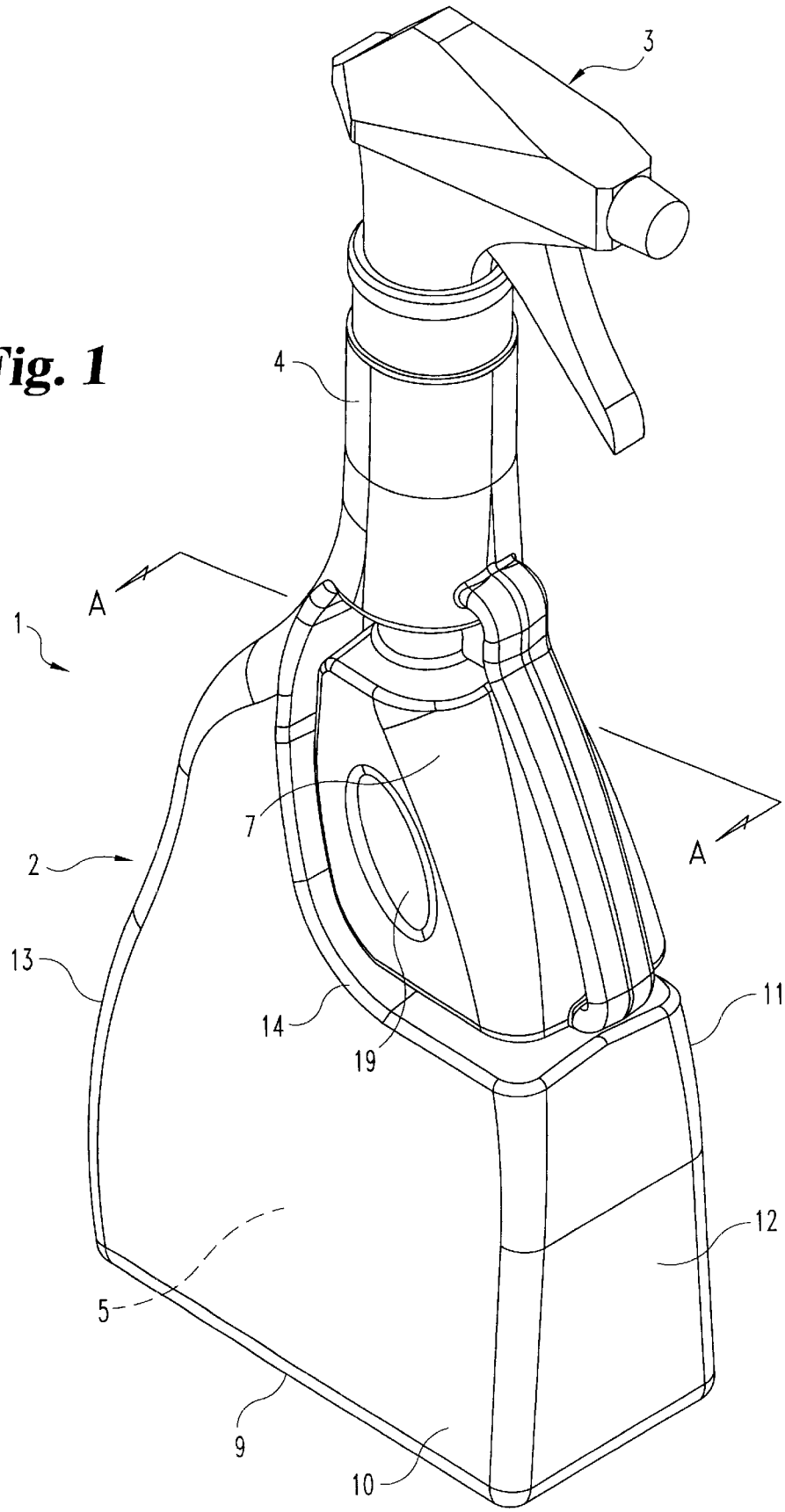
FIG. 1 is a perspective view of one embodiment of dispensing container in accordance with the second aspect of the invention.

Referring to FIG. 1, there is illustrated a liquid dispensing container 1 comprised of a bottle 2 (the structure of which is described more fully below) and a conventional trigger-spray unit 3 mounted on the neck 4 of the bottle.

Bottle 2 is a one-piece moulding of flexible plastics material, which is preferably transparent or translucent.

In more detail, the bottle 2 comprises (in addition to its aforementioned neck 4) a main chamber 5 which serves to hold a liquid 6 (FIG. 3) to be dispensed by the trigger spray unit 3 and a secondary chamber 7 holding a concentrate 8 from which liquid 6 is prepared as necessary by dilution as detailed below.

Figure 2:
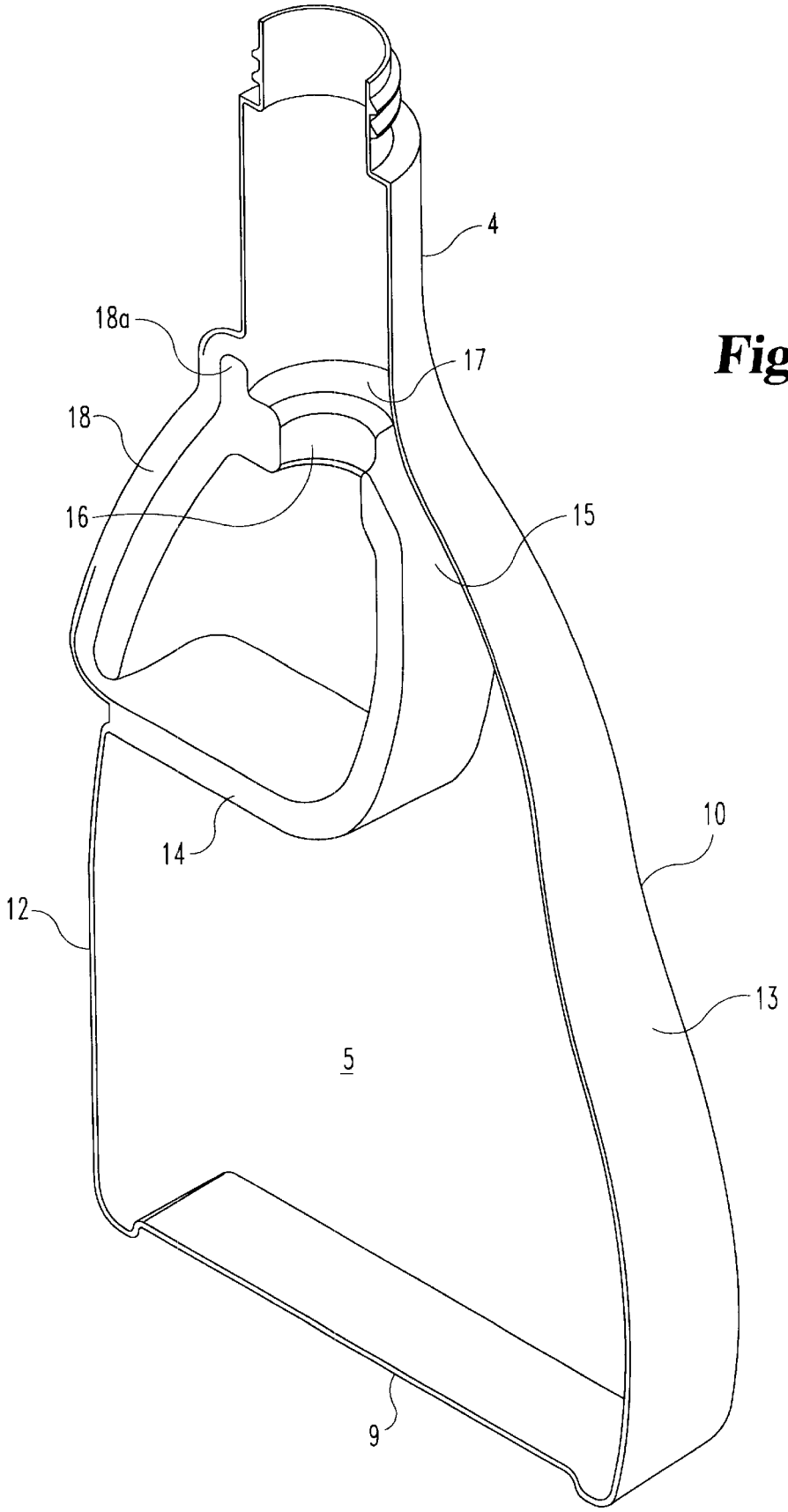
FIG. 2 is a schematic sectional view of the bottle "as-moulded" of the container illustrated in FIG. 1 taken on the line A—A.

As shown in FIGS. 1 and 2, the main chamber 5 has a base 9, front and rear walls 10 and 11, and side walls 12 and 13, the latter being of greater height than the former. The upper region of main chamber 5 is defined by a wall 14 which initially extends from the top of side wall 12 generally horizontally towards side wall 13 and then turns upwardly so as to define a first duct 15 providing communication between an upper region of main chamber 5 and the neck 4.

The subsidiary chamber 7 is positioned beneath the neck 4 but above the horizontal section of wall 14 and to one side of the upwardly turned portion thereof.

In the "as-moulded" form of the bottle (see FIG. 2), the upper region of secondary chamber 7 is formed with a circular aperture 16 having a part spherical seating surface 17. Furthermore a second duct 18 extends along an outer region of the secondary chamber 7 and provides communication between the lower region thereof and the neck 4 of the bottle. More particularly, duct 18 extends generally perpendicularly into the neck 4 and a splashguard 18*a* is provided to prevent liquid entering (and passing downwardly along) the duct 18.

A further feature of the secondary chamber 7 is the provision on the sides thereof of finger-locating depressions 19.

Figure 3:
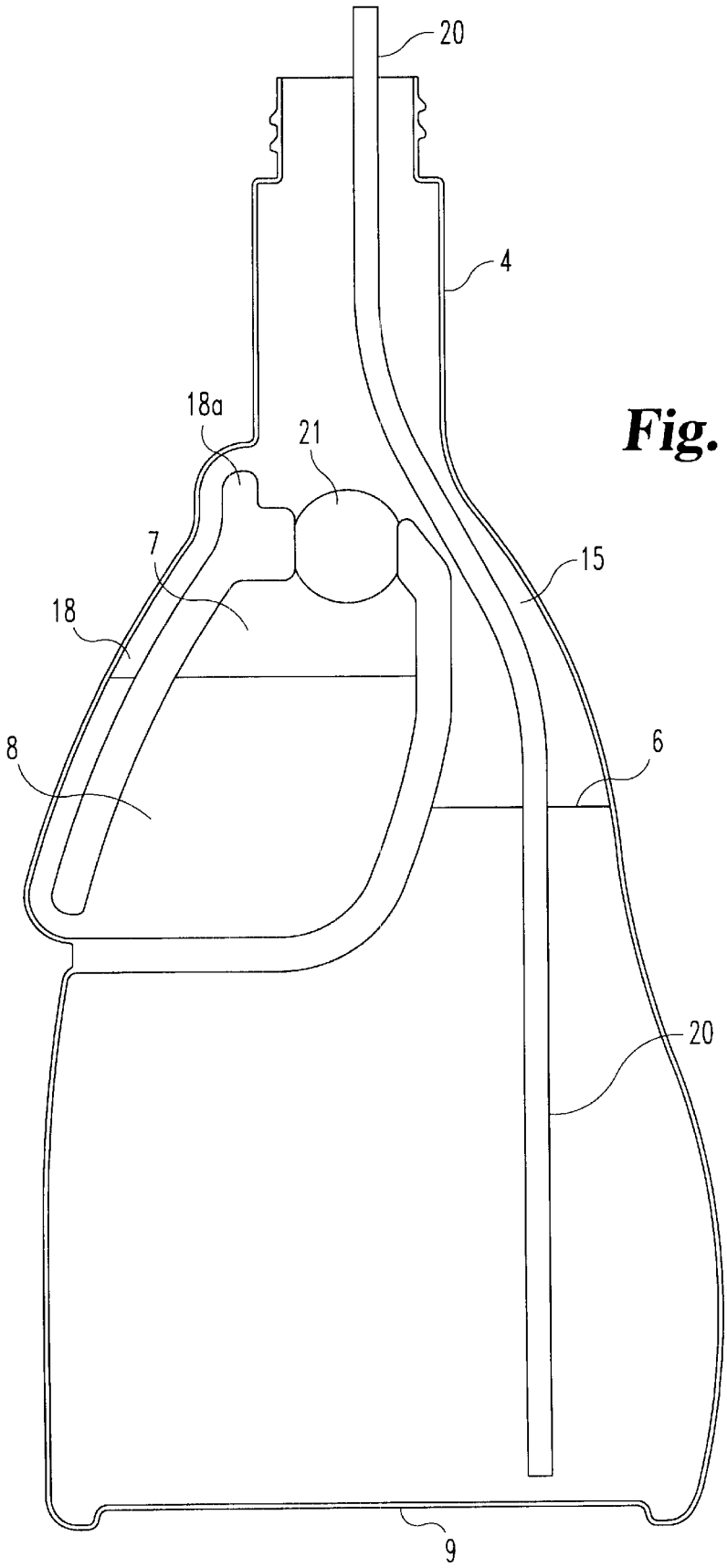
FIG. 3 is a schematic cross-sectional view of the container of FIG. 1 taken on the line A—A.

In its assembled form ready for use, the bottle is as illustrated in FIGS. 1 and 3 from which it will be seen that the dip-tube 20 of trigger spray unit 3 extends through the duct 15 to the lower region of the main chamber 5. Furthermore, the aperture 16 in the top of secondary chamber 7 is closed by a plastics sealing ball 21.

The manner in which the bottle in the "as-moulded" form illustrated in FIG. 2 is prepared for use as illustrated in FIG. 3 is as follows.

The concentrate 8 is introduced through the aperture 16 in the top of secondary chamber 7 via a suitable filling tube (not shown) inserted in the top of the bottle 2 and along the neck 4 thereof. After filling of the secondary chamber 7 to the appropriate level, the filling tube is withdrawn and the sealing ball 21 is inserted into the neck 4 of the bottle so that the ball locates in the part-spherical seating surface 17. Pressure is then applied to the ball (e.g. by means of a rod or the like) so that it is located firmly in the aperture 16. In the next step the main chamber 5 is filled with the liquid 6. Finally the trigger spray unit 2 is located on the bottle, so that the dip tube extends along duct 15 to the bottom of the main chamber 5.

The contents of main chamber 5 may now be dispensed by operation of the trigger spray unit 3 in a manner which is entirely conventional.

Once the liquid 16 in main chamber 5 has been exhausted, the depressions 19 on the side of the secondary chamber 7 are squeezed towards each other so as to express concentrate 8 upwardly through the duct 18, over the top of the secondary chamber 7 and downwardly via duct 15 into the main chamber 5. With the trigger spray unit removed, water may be added through the neck of the bottle so as to dilute the concentrate and therefore refill chamber 5. Water is prevented from entering duct 18 by means of splashguard 18*a* and the fact that duct 18 opens perpendicularly into the neck 4.

It will be appreciated that numerous refills of main chamber 5 may be made from the concentrate 8 in the secondary chamber 7 although the actual number of refills will depend on the relative volumes of the chambers 5 and 7 and the dilution required for the concentrate 8. It is possible, for example, for the bottle to provide for only one refill in which case the entire contents of secondary chamber 7 are discharged into the main chamber 5 for dilution. Generally however the container will be such that two or (preferably) more refills of main chamber 5 are possible with the volume of concentrate 8 provided in secondary chamber 7.

A number of changes may be made to the embodiment of the invention that has been described and illustrated.

Thus, for example, the side walls of secondary chamber 7 may be provided with graduation marks to assist in determining how much concentrate 8 is to be transferred to main chamber 5 for the purposes of one refill thereof. Similarly main chamber 5 may also have graduation marks to indicate the level of dilution required for the concentrate.

In an alternative arrangement, the main chamber 5 of the container 1 as supplied to the end-user may be empty (rather than being pre-filled in the factory) thus providing substantially reduced transportation weight. In this case it is necessary for the main chamber 5 to be filled with liquid 6 by expressing concentrate 8 from the secondary chamber 7 and then diluting the expressed concentrate.

Furthermore although the container has been illustrated as incorporating a trigger-spray unit this is not essential. It is possible, for example, to use other forms of dispensing arrangement. It is also possible for the bottle simply to have a closure element (e.g. a screw-cap or other seal). This will particularly be the case where the liquid 6 is for use via a watering can. A still further possibility is for the container 1 to be supplied in a package which incorporates both a screw cap (or other seal) and a trigger-spray head for multi-use purposes.

What is claimed is:

1. A bottle comprising a main chamber, a secondary chamber of lesser volume than the main chamber, a first duct providing communication between the main chamber and the mouth of the bottle and a second duct providing for communication between the main chamber and a lower region of the secondary chamber, said secondary chamber having a filling aperture located below the opening of the bottle characterised in that the secondary chamber is provided above at least a portion of the main chamber and in that said first duct is to one side of said secondary chamber.

2. A bottle as claimed in claim 1 wherein the upper region of the main chamber is defined by a partition element having a first generally horizontal portion extending from a first side of the main chamber towards the opposite second side thereof and a second generally upwardly extending portion, said secondary chamber being located above said first horizontal portion of the partition and said first duct being defined between said second vertical portion of the portion and said second side wall of the main chamber.

3. A bottle as claimed in claim 1 wherein said second duct extends from the lower region of the secondary chamber to above the filling aperture thereof.

4. A bottle as claimed in claim 1 which is flexible plastics material.

5. A bottle as claimed in claim 4 wherein the plastics material is transparent or translucent.

6. A bottle as claimed in claim 4 wherein the sides of the secondary chamber are provided with finger-locating depressions.

7. A bottle as claimed in claim 1 wherein said filling aperture of the secondary chamber is circular.

8. A bottle as claimed in claim 7 wherein said aperture has a part spherical seating surface.

9. A dispensing container comprising a bottle as claimed in claim 1, a dilutable concentrate in said secondary chamber, a plug provided in said filling aperture to effect closure thereof, and closure element on the mouth of the bottle.

10. A container as claimed in claim 9 wherein the main chamber contains a liquid which is a diluted form of the concentrate in the secondary chamber.

11. A dispensing container comprising:

(i) a bottle comprising a main chamber, a secondary chamber of lesser volume than the main chamber, a first duct providing communication between the main chamber and the mouth of the bottle and a second duct providing for communication between the main chamber and a lower region of the secondary chamber, said secondary chamber having a filling aperture located below the mouth of the bottle;

(ii) a dilutable concentrate in said secondary chamber;

(iii) a plug provided in said filling aperture to effect closure thereof, (iv) a diluted form of said concentrate in the main chamber; and (v) a closure element on the mouth of the bottle.

12. A container as claimed in claimed in claim 9 wherein the plug is a sphere.

13. A container as claimed in claim 9 having a trigger-spray unit which provides the closure element on the mouth of the bottle.

* * * * *